United States Patent [19]

Van Uden et al.

[11] Patent Number: 4,578,132

[45] Date of Patent: Mar. 25, 1986

[54] PROCESS FOR THE PRODUCTION OF TUFTED CARPET TILES

[75] Inventors: Adrianus A. Van Uden, Tiel; Johannes A. H. Claessen, Leusden, both of Netherlands

[73] Assignee: Heuge Export AG, Luzern, Switzerland

[21] Appl. No.: 535,371

[22] Filed: Sep. 23, 1983

[30] Foreign Application Priority Data

Sep. 23, 1982 [NL] Netherlands ..... 8203691

[51] Int. Cl.[4] ..... D05C 15/04; D06C 7/00; D06P 5/20

[52] U.S. Cl. ..... 156/72; 156/277; 8/929; 28/159

[58] Field of Search ..... 156/72, 322, 308.2, 156/435, 277, 314; 8/929, 930; 428/229, 95, 96, 85, 235; 139/399, 2; 28/159, 147; 264/346

[56] References Cited

U.S. PATENT DOCUMENTS 2,266,846 2/1940 Buff ..... 28/159 X
4,101,270 7/1978 Fleissner ..... 8/929 X
4,142,852 3/1979 Schuierer ..... 8/929 X
4,173,452 11/1979 Fleissner ..... 8/929
4,392,863 7/1983 Kaufmann et al. ..... 264/346 X

FOREIGN PATENT DOCUMENTS 7201565 9/1972 Netherlands .

*Primary Examiner*—Edward Kimlin
*Assistant Examiner*—Ramon R. Hoch

[57] ABSTRACT

In the production of decorated tufted carpet tiles, a tufted carpet web is made by tufting a pile yarn in a substrate, precoating and backing the tufted substrate on the backside, followed by dyeing, imprinting with a pattern, steaming, washing and drying the carpet web, and thereafter by punching or cutting tiles from the carpet web in the process, the carpet web, prior to the dyeing step and preferably after precoating, is heat treated by being exposed to a temperature of 120°-200° C., preferably 140°-170° C., for 1-8 minutes, preferably for 3-5 minutes, while it is freely supported on an auxiliary carrier, and then subjected to cooling to below 50° C.

3 Claims, No Drawings

PROCESS FOR THE PRODUCTION OF TUFTED CARPET TILES

BACKGROUND OF THE INVENTION

The invention relates to a process for the production of tufted carpet tiles, comprising making a tufted carpet web by tufting a pile yarn in a substrate in a usual way, and providing the tufted substrate on the backside with a precoat of a rubber latex and with a backing. The raw carpet is then subjected to dyeing, steaming, washing and drying, and then the tiles are cut or punched, from the carpet web.

A similar process is substantially well-known. In the book "Textielwaren" by P. J. M. van Gorp and A. J. G. M. Hombergen, Wolters-Noordhoff, 1974, in particular on pages 400–405, the production of dyed tufted carpet is described. In Dutch Patent Application No. 72 01565 it is stated on page 2 that a usual method for the production of carpet tiles consists of punching tiles from a backed carpet web.

Both for (wall-to-wall) carpeting and for carpet tiles generally accepted requirements for dimensional stability set up by the "Deutsches Teppich Institut" at Aachen apply, namely that the maximum variations in dimensions in the tests described in DIN 54318 must remain within the following limits of tolerance:

| | wall-to-wall carpeting | carpet tiles |
|---|---|---|
| growth | +0.4% | +0.2% |
| shrinkage | −0.8% | −0.4% |

The conventional tufted carpet tiles comply with these requirements and do not give problems in their use.

Nowadays, there is not only a demand for dyed, tufted carpet tiles, but also for repeating pattern decorated, tufted carpet tiles. When attempts are made to produce such tiles by making in a usual way (vide Textielwarn l.c., pages 405/406) a dyed and imprinted, tufted carpet web and cutting tiles from this decorated, tufted carpet web, the percentage of waste in the form of tiles on which the repeating pattern is shifted or deformed with regard to the tile edges or tiles where the repeating pattern is even partly cutt off, is unacceptably high.

The high requirements already set for the dimensional stability of carpet tiles are still inadequate in that case.

SUMMARY OF THE INVENTION

It has now been found that this problem is eliminated when, prior to dyeing, the carpet web is exposed to a special heat treatment while it is freely supported on an auxiliary carrier.

The process according to the invention is therefore characterized in that decorated tiles are produced by imprinting the carpet web with a pattern between the dyeing and steaming steps. However, prior to the dyeing process and while it is freely supported on an auxiliary carrier, the carpet web is heat treated by being exposed to a temperature of 120°–200° C. for 1–8 minutes, followed by cooling to a temperature below 50° C.

What exactly happens in the heat-treatment is not known. The macroscopic effect is that the carpet web in general shrinks a little and, after the heat treatment, has exceptionally good dimensional stability.

DETAILED DESCRIPTION OF THE PREFERRED EMBODIMENTS

These treatments are generally applicable to any type of tufted carpet, whatever the nature of the substrate (fabric of synthetic filaments or a non-woven web of synthetic filaments or fibres), the type of pile yarn that is applied (woolen yarn, polyamide yarn, mixed wool and polyamide yarn), the type of pile (cut pile, loop pile), the pile density, the nature of the precoat and of the backing.

In this connection it should be noted that nowadays tufted carpet (and also carpet tiles) is (are) mainly made on a substrate consisting of a polypropylene fabric or a non-woven web of synthetic filaments, while, for the backing in particular, often mixtures of bitumen with or without fillers, or mixtures of atactic polypropylene (APP) with fillers, or PVC are used.

The heat treatment according to the invention should take place before dyeing the carpet web; the carpet web then is so stable at the time of imprinting, steaming, washing and drying that no troublesome variations appear in the imprinted pattern or in the place of the imprinted pattern on the carpet.

Preferably, the heat-treatment takes place after precoating and in particular after application of the backing. When applying the precoat and the backing (but especially when applying the precoat) the tufted "carpet"-web is exposed to mechanical tensions. If this were to happen after the heat-treatment, this effect would detract from the effect that is achieved with the heat-treatment.

The duration of time of the heat-treatment may vary between 1 and 8 minutes, the duration of time possibly being shorter according as the temperature to which the carpet web is exposed is raised. A duration of time shorter than 1 minute does not give a result suitable in practice. A longer duration of time than 8 minutes does not give an improvement of the result. The best results are achieved in a duration of time of between 3 and 5 minutes, in particular when the temperature to which the carpet web is exposed is between 140° and 170° C. Therefore, preferably both conditions are complied with together.

The heat-treatment must take place while the carpet web is freely supported on an auxiliary carrier, i.e., not under tension. As a result, the carpet web can freely shrink under the influence of the heat.

This can suitably be achieved by collecting the carpet web coming from the precoat step or from the coating step where the backing was applied on an endless belt which passes through an oven having an air temperature of between 120° and 200° C., in particular between 140° and 170° C. This endless belt suitably consists of a screen gauze.

After heat-treatment the carpet web is then taken from the endless belt and dyed, imprinted, steamed, washed and dried.

Very suitably, the carpet web can first be cut into sheets (platines).

Such sheets or platines can be handled more easily and can therefore more easily be exposed to the heat-treatment while freely supported on an auxiliary carrier.

These sheets or platines can also be placed on an endless (screen) belt and in this way be passed through the heating oven or, be placed in a paternoster elevator (having bottoms and walls of gauze) and therewith passed through the heating oven.

The dyeing and imprinting of the carpet web or the carpet sheets (platines) takes place in the process according to the invention in a conventional manner. In addition to the imprinting techniques mentioned in "Textielwaren" l.c., other very suitable imprinting techniques can be utilized in particular imprinting according to the "foam printing principle" and printing according to the "chromotronic jet dye principle".

Steaming, washing and drying of the dyed and imprinted carpet web (the sheets) also takes place in a usual manner.

For steaming, saturated steam under atmospheric pressure can suitably be used; the dyed and imprinted carpet web (sheets) is (are) exposed to an atmosphere having a relative humidity (RH) of 100% and a temperature of 98°–100° C. The treatment time is suitably 2–8 minutes, in particular 4–6 minutes.

After steaming the carpet web (the sheets) is (are) suitably washed in three steps at an ever lower temperature, in the first step at 70° C. and in the last one cold (i.e. at 10°–18° C.).

Drying generally takes place at temperatures of between about 75° C. and 130° C., the drying time being adapted to the temperature used. It has appeared to be very suitable either:

(a) to dry at (120±2°) C. for 3–5 minutes (b) to dry at (80±2°) C. for 50–70 minutes.

The effect that is achieved with the process according to the invention is demonstrated in the following examples.

EXAMPLE I

A "semi-manufactured"-carpet web was made in a conventional tufting plant by tufting a substrate consisting of a non-woven web of bicomponent filaments with a sheath consisting of 30% of polyhexamethylene adipamide and a core consisting of 70% of polyethylene terephthalate, width 418 cm, with a pile yarn of polyhexamethylene adipamide, to form a loop pile and applying on the backing of the tufted web a "precoat" of a chalk-filled latex of carboxylated styrene-butadiene rubber (SBR).

Composition of the latex:

carboxylated SBR: 12.5% by weight chalk: 62.5% by weight water: 25% by weight.

Amount of latex applied: 1067 g/m2 (corresponding to 800 g of solids per m2).

The temperature during application of the "precoat" on the backside of the web is 120° C. and on the pile side is 180° C.

The "semi-manufactured" web having a width of 418 cm was cut into two webs, each having a width of 209 cm.

Both webs were then provided with a bitumen backing according to the UBL-system. From the backed webs, platines were cut, having dimensions of 154×209 cm.

Half of the platines, pile at the top, were placed on an endless belt screen and passed through an oven heated to (150±2)°C., with a residence time of 5 minutes.

After having left the furnace, the platines were cooled to 40° C.

The platines had shrunk about 1.2% in the longitudinal direction and about 2.6% in the lateral direction.

The platines subjected to this heat-treatment were then imprinted according to the foam-printing principle, then steamed for 5 minutes with saturated steam (temperature 98°–100° C.; relative humidity 100%), washed in three steps with decreasing temperature (first step 70° C., third step 16° C.) and dried at 120° C. for 4 minutes.

On testing according to DIN 54318, these platines showed an average shrinkage of −0.095% in the longitudinal direction and −0.052% in the lateral direction.

Tiles were punched from the platines. In these tiles, the pattern was presented exactly within the cut edges.

The other group of platines was imprinted, steamed, washed and dried in the above-mentioned way without their having been exposed to the heat treatment according to the invention. The shrinkage after all these treatments amounted to:

longitudinal direction: −0.39% lateral direction: −0.72%.

From these platines, tiles were punched as well. In more than 25% of the tiles, the pattern had been partly cut off.

EXAMPLE II

The process of Example I was repeated, while using a pile yarn from poly-ε-caprolactam, and a semi-manufactured product with a cut pile was made.

When applying the "precoat", the temperature was 135° C. instead of 120° C. on the back side.

This semi-manufactured product was provided with a backing of bitumen as in Example I. From the backed webs, platines of 154×209 cm were cut, half of which was exposed to the same heat treatment as in Example I and the other half did not receive any heat treatment. All the platines were imprinted, steamed, washed and dried, as described in Example I.

Both types of platines showed a shrinkage on the same order as was measured with respect to the correspondingly heat treated and non-heat treated platines of Example I.

EXAMPLE III

The process of Example I was repeated, except that the platines were imprinted according to the chromotronic jet dye principle.

The results corresponded to the results obtained in Example I.

We claim:

1. In a process for the production of tufted carpet tiles comprising making a tufted carpet web by tufting one surface of a substrate with a pile yarn, providing the tufted substrate on the other surface with a coating of a rubber latex and with a tile backing selected from the group consisting of bitumenous materials and synthetic resins to provide a raw carpet web, and thereafter dyeing, steaming, washing and drying said raw carpet web and subsequently cutting tiles from said carpet web, the improvement comprising:

A. subsequent to the steps of coating and application of said tile backing and prior to the step of dyeing thereof, heat treating said raw carpet web by:

(i) freely supporting said web in an untensioned condition upon an auxiliary carrier so as to permit said web to shrink freely and stress relieve, (ii) exposing said supported web to a temperature of 120°–200° C. for 1 to 8 minutes, and (iii) cooling said web to a temperature below 50° C.; and B. between said dyeing and steaming steps, imprinting said carpet web with a pattern.

2. The process according to claim 1 wherein said heat treating step exposes said carpet web to a temperature of 140°–170° C. for 3–5 minutes.

3. The process according to either of claims 1 or 2 wherein said heat treatment step is effected upon sheets (platines) cut from said carpet web.

* * * * *